US005316859A

United States Patent [19]

Harada et al.

[11] Patent Number: 5,316,859

[45] Date of Patent: May 31, 1994

[54] SPRAY-COATED ROLL FOR CONTINUOUS GALVANIZATION

[75] Inventors: Yoshio Harada; Kazumi Tani, both of Hyogo, Japan

[73] Assignee: Tocalo Co., Ltd., Hyogo, Japan

[21] Appl. No.: 124,657

[22] Filed: Sep. 9, 1993

Related U.S. Application Data

[63] Continuation of Ser. No. 859,863, Mar. 30, 1992, abandoned.

[51] Int. Cl.[5] ..... B21B 27/02; B05D 1/10

[52] U.S. Cl. ..... 428/472; 428/457; 428/469; 428/332; 428/665; 428/697; 428/698; 29/895

[58] Field of Search ..... 29/110, 132, 148.4 D, 29/129.5; 428/665, 457, 469, 472, 698, 697, 332

[56] References Cited

U.S. PATENT DOCUMENTS

| | | | |
|---|---|---|---|
| 4,731,253 | 3/1988 | Du Bois | 427/423 |
| 4,826,734 | 5/1989 | Jackson et al. | 428/698 |
| 4,912,835 | 4/1990 | Harada et al. | 427/423 |
| 5,070,587 | 12/1991 | Nakahira et al. | 29/132 |

FOREIGN PATENT DOCUMENTS

| | | |
|---|---|---|
| 54-69529 | 6/1979 | Japan . |
| 56-152541 | 11/1981 | Japan . |
| 58-25468 | 2/1983 | Japan . |
| 61-37955 | 2/1986 | Japan . |
| 61-117260 | 6/1986 | Japan . |
| 64-87005 | 3/1989 | Japan . |
| 64-87006 | 3/1989 | Japan . |
| 1-225761 | 9/1989 | Japan . |
| 1-258805 | 10/1989 | Japan . |
| 2-43352 | 2/1990 | Japan . |
| 2-236266 | 9/1990 | Japan . |
| 3-285885 | 12/1991 | Japan . |
| 4-13854 | 1/1992 | Japan . |
| 4-13857 | 1/1992 | Japan . |

OTHER PUBLICATIONS

Dorfman et al. "A technical assesment of high velocity oxygen fuel versus high energy plasma tungsten carbide-cobalt coatings for wear resistance" Conference 1989.

Ramnath et al. "Characterisation and wear performance of plasma sprayed WC-Co coatings" Mats Sc & Tech Apr. 1989 No. 5 vol. 4 pp. 382-388.

Barbezak et al. "Applying Tungsten Carbide Cobalt Coatings by High Velocity Combustion Spraying" Sulzer Techn. Rev. Apr. 1988 pp. 4-10.

English abstract of Japanese Patent Laid Open Publication No. 3-285885.

English claims of Japanese Patent Laid Open Publication No. 4-13854.

English claims of Japanese Patent Laid Open Publication No. 4-13857.

English abstract of Japanese Patent Laid Open Publication No. 64-87005.

English abstract of Japanese Patent Laid Open Publication No. 64-87006.

English abstract of Japanese Patent Laid Open Publication No. 1-258805.

English abstract of Japanese Patent Laid Open Publication No. 2-43352.

English abstract of Japanese Patent Laid Open Publication No. 2-236266.

English abstract of Japanese Patent Laid Open Publication No. 54-69529.

English abstract of Japanese Patent Laid Open Publication No. 61-37955.

English abstract of Japanese Patent Laid Open Publication No. 61-117260.

English abstract of Japanese Patent Laid Open Publication No. 58-25468.

English abstract of Japanese Patent Laid Open Publication No. 1-225761.

*Primary Examiner*—A. A. Turner

*Attorney, Agent, or Firm*—Sandler Greenblum & Bernstein

[57] ABSTRACT

A roll used for continuous galvanization is provided at its surface with a spray-coated layer made from a cermet spraying material consisting essentially of WC-Co. The spray-coated layer consists of WC, at least one specified intermetallic compound and at least one of amorphous W-C-Co compound and free C, but contains no free W and free Co.

7 Claims, 2 Drawing Sheets

SPRAY-COATED ROLL FOR CONTINUOUS GALVANIZATION

This application is a continuation of application Ser. No. 07/859,863, filed Mar. 30, 1992, now abandoned.

BACKGROUND OF THE INVENTION

1. Field of the Invention

The present invention relates to a spray-coated roll used in an apparatus for continuously galvanizing steel sheets, and more particularly, to the surface coating structure of the roll.

2. Discussion of Background Information

Galvanized steel sheets (inclusive of zinc-aluminum hot dipped steel sheets) are used as outer body panels for vehicles, corrosion resistant material for building or the like, and are manufactured mainly by an apparatus as shown in FIG. 1.

That is, a steel sheet 1 that is to be galvanized is first annealed in a continuous annealing furnace, then, the steel sheet, guided by a turn down roll 11, is passed through a snout 2 maintained in a reducing atmosphere and then introduced into a ceramic pot 10 containing the galvanizing bath 3, where the steel sheet 1 is galvanized while passing along a sink roll 4, a front support roll 5 and a back support roll 6. Thereafter, the galvanized steel sheet is passed through wiping nozzles 7, a touch roll 8 and a top roll 9 to adjust the thickness of the resulting galvanized layer.

In general, the rolls described above, except roll 11, are immersed in the galvanizing bath or are in contact with the high temperature galvanized steel sheet, so that they are required to satisfy the following conditions:

(1) the roll is hardly subject to erosion due to molten metal;

(2) the roll is hardly abraded by contact with the passing steel sheet;

(3) when the roll is taken out of the galvanizing bath for maintenance and inspection, zinc easily peels off of the surface of the roll;

(4) the roll can be used over a long period of time; and (5) the cost of the roll is low.

In order to provide rolls satisfying these conditions, i.e., rolls used for galvanization, there have hitherto been proposed the following surface coating methods:

(a) a self-fluxing alloy is sprayed onto the surface of the roll as disclosed in Japanese Patent Laid-Open No. 54-69529;

(b) a ceramic such as $ZrO_2$, $Al_2O_3$ or the like is sprayed onto the surface of the roll as disclosed in Japanese Patent Laid-Open Nos. 61-37955 and 61-117260;

(c) a surface coating layer of 0.1–2.4 mm in thickness is formed consisting of at least one of WC, $Cr_3C_2$ and TiC and the reminder of hot corrosion-resistant metal or its alloy is disclosed in Japanese Patent Application Laid-Open No. 58-25468; and (d) a spray-coated layer composed of WC-Co series cermet material containing 5–28 wt % of Co and having a porosity of not more than 1.8% is formed on the roll surface as disclosed in Japanese Patent Laid-Open No. 1-225761.

Among these conventional coated layers, cases (a) and (b) are more resistant than a non-treated steel roll to the galvanization process. However, the self-fluxing alloy layer of (a) or the oxide ceramic layer of (b) tend to locally peel off from the surface of the roll when in use over about 2 weeks. This local peeling of the roll surface transfers an undesired pattern onto the sheet metal and, consequently, the commercial value is lowered considerably.

In case (c), the carbide such as WC, $Cr_3C_2$ and TiC or the like shows an excellent resistance to erosion due to the galvanization process, but the coated layer cannot be formed by the spraying process alone. In this regard, the carbide is applied with a metal as a binder to form a so-called cermet coated layer. However, the cermet coated layer has the drawback that the performance is lowered considerably in accordance with the kind of the metal used as the binder, and cannot be put into practical use. That is, when the carbide is mixed with Ni, Si or the like as a heat-resistant metal, the resulting coated layer is rapidly eroded by the galvanizing solution with the resultant loss of function of the coated layer.

Moreover, when the cermet coated layer is made from a carbide applied with Co, it is relatively durable to the galvanizing solution. However, this coating may be eroded in a short time although the cause of erosion is not clear. The latter coated layer is required to have a thickness of not less than 0.1 mm. If the thickness is less than 0.1 mm, the effect is poor.

In case (d), the inventors have proposed a method for improving the carbide-Co cermet coated layer. This method restricts the porosity of the coated layer to not more than 1.8% and thereby, even at a thickness of less than 0.1 mm, the coated layer is sufficiently durable to the galvanizing solution.

Recently, the appearance of the galvanized steel sheet has become more important than improvements to the corrosion resistance, as a performance requirement. That is, a slight cloud of gloss generated in the galvanized surface, a linear transferred damage on the galvanized surface due to groove formed in the sink roll immersed in the galvanizing bath, and the like, which have been ignored in the conventional technique, have recently become important performance criteria.

In the spray-coated layer of WC-Co cermet system, it is often difficult to produce high quality galvanized steel sheets by defining only the amounts of both components used. Moreover, if the resulting WC-Co cermet layer satisfies the requirements, it has a drawback that the life is relatively short.

SUMMARY OF THE INVENTION

It is, therefore, an object of the invention to form a spray-coated layer on the surface of a roll used for galvanization, wherein the spray-coated roll has an excellent resistance to corrosion against molten zinc or Zn-Al molten alloy.

It is another object of the invention to provide a spray-coated roll effective for the formation of a galvanized layer on a steel sheet having improved galvanizing operation and high productivity.

It is the other object of the invention to provide galvanized steel sheets having an excellent quality.

The inventors have made various crystallographical studies of WC-Co spray-coated layers in order to develop a spray-coated layer for a sink roll in accordance with the above requirements regarding the quality of the galvanized steel sheet. The inventors have found that an excellent resistance to erosion of the galvanizing solution is exhibited by selecting a coating composition from among various intermetallic compounds and decomposition compounds produced in the production of WC-Co series spray coating materials and through heat hysteresis in the spray coating as discussed below.

According to the invention, there is the provision of a spray-coated roll for continuous galvanization, comprising a roll drum and a spray-coated layer of a cermet material comprising WC-Co formed on an outer peripheral surface of the roll drum; said spray-coated layer containing at least one substance selected from the group consisting of intermetallic compound, amorphous W-C-Co compounds and free carbon and having a structure that free W and free Co are hardly detected by an X-ray diffractometry; and said intermetallic compound being selected from $W_2C$, $Co_3W_3C$, $Co_6W_6C$, $Co_2W_4C$, $Co_2W_4C$ and $W_6C_{2.54}$.

In a preferred embodiment of the invention, the spray-coated layer has a thickness of 0.04–1.85 mm and a porosity of not more than 1.8%.

BRIEF DESCRIPTION OF THE DRAWINGS

The invention will be described with reference to the accompanying drawings, wherein.

DESCRIPTION OF THE PREFERRED EMBODIMENTS

Figure 1:
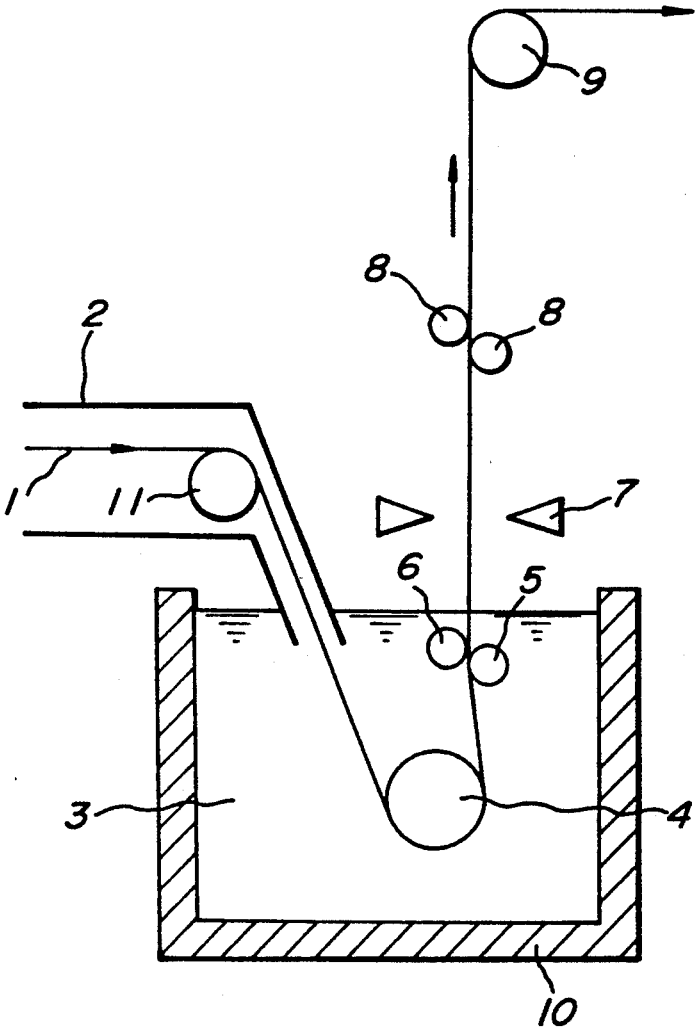
FIG. 1 is a schematic view showing an outline of a galvanization apparatus.

In general, WC-Co spraying material is produced by the following processes:

(i) WC and Co are sintered at a high temperature of not lower than 1000° C., in a hydrogen gas atmosphere, having a very low oxygen partial pressure, which is mechanically crushed and sieved to particle size range suitable for spraying (sintering and crushing process);

(ii) the surfaces of WC particles are subjected to Co plating (coating process);

(iii) WC particles and Co powder are mechanically mixed (agglomerating process);

(iv) Co is fused in an atmosphere containing no oxygen and WC particles are charged to react to them and then the resulting reaction product is mechanically crushed and sieved (casting and crushing process); and (v) the powder produced in any one of above process (i)-(iv) is fused by plasma flame or laser, and is pulverized and sieved (plasma-densifying or laser-densifying process).

The inventors have confirmed that WC-Co spraying materials produced by the above processes are the same in the chemical composition but are largely different in the crystalline state of the components constituting the material. That is, in these spraying materials, having a hysteresis exposed to a high temperature state, as in processes (i), (iv) and (v), WC reacts with Co to produce $W_2C$, $Co_3W_3C$, $Co_6W_6C$, $Co_2W_4C$, $Co_2W_4C$ and the like. On the other hand, in the spraying materials produced by processes (ii) and (iii), WC and Co are existent at a freely mixed state.

As mentioned above, the crystalline structure of components constituting the WC-Co spraying material differ largely between before and after the production of the spraying material by the above processes. Furthermore, it has been found that the crystalline structures largely affect the resistance to galvanizing bath solution. That is, even when the chemical composition of these spraying materials are merely called WC-Co series spraying materials, it has been confirmed that not all of these materials are necessarily suitable as a coating layer on a roll for galvanization. In other words, in order to form the spray-coated layer, according to the invention, it is necessary to use the spraying materials produced by the processes (i), (iv) and (v).

As a method of producing the coated layer using the spraying material described above, use may be made of (A) plasma coating method, (B) high-velocity oxygen/fuel method using combustion energy as a heat source (hereinafter referred to as HVOF method), (C) detonation method using explosion energy of combustible gas and the like. In this regard, these methods cause the spraying material to be subjected to heat hysteresis, which results in a further change in the crystalline structure of the spraying material.

In general, plasma flame produces a high temperature of several to 20,000° C. so that it can easily melt not only metal, but also high melting point ceramics. In this regard, when the WC-Co spraying material is subjected to plasma coating, the WC is either decarburized in the plasma flame because of the high temperature, or the WC reacts with Co. Hence, the chemical composition of the WC-Co spraying material is changed from its chemical composition before the coating process. Moreover, the decarburized product of WC is poor in its resistance to galvanizing bath solution and is unfavorable as a coating for the sink roll. For example, when the spraying material produced by the above sintering and crushing process (WC-12% Co) is subjected to plasma coating in air, WC is decarburized according to the following reaction formulae:

$$2WC \rightarrow W_2C + C \ldots \quad (1)$$

$$W_2C + O_2 \rightarrow 2W + CO_2 \ldots \quad (2)$$

The resulting spray-coated layer becomes porous and hot zinc easily penetrates into the inside of the layer with the result that the steel of the roll substrate is eroded considerably. Furthermore, W produced according to the reaction of the formula (2) reacts with the hot zinc, so that the resistance to galvanizing bath solution in the spray-coated layer itself is lowered.

The chemical change in the spraying material caused by the plasma flame, as mentioned above, differs in accordance with the production process of WC-Co spraying material (production hysteresis), as mentioned later. Further, this chemical change directly affects the resistance to galvanizing bath solution. Therefore, the spray-coated layer, having excellent resistance to galvanizing bath solution, cannot be obtained if only the chemical composition of the spraying material is defined or if only the spraying method is defined.

In the spraying method using, as energy for combustion, gas such as propane, acetylene, propylene, hydrogen or the like as a heat source, the temperature of the heat source will be low compared with the plasma flame and is not higher than 3000° C. However, the WC-Co spraying material is decomposed or reacted even at this temperature, so that the resistance to galvanizing bath solution of the resulting spray-coated layer cannot accurately be judged based on this spraying method or the chemical composition of the material.

Figure 2A:
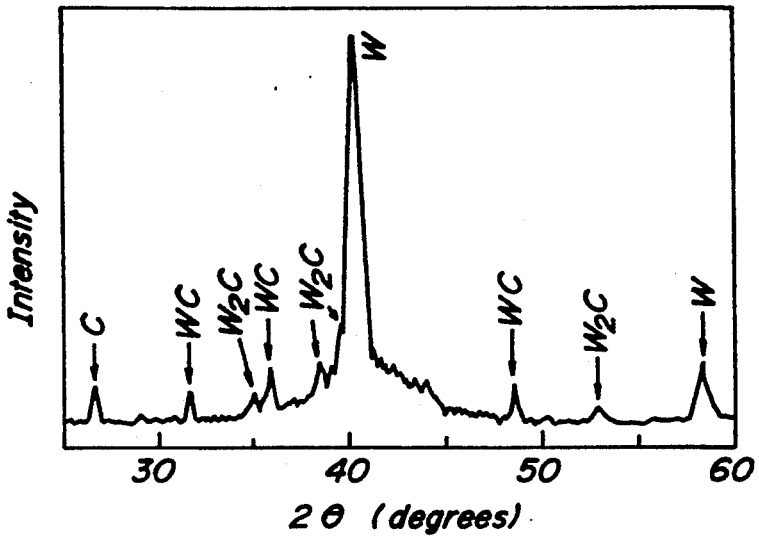
FIGS. 2*a* and 2*b* are charts of X-ray diffraction patterns of spray-coated layers from WC-12% Co material synthesized by a sintering and crushing process.
Figure 2B:
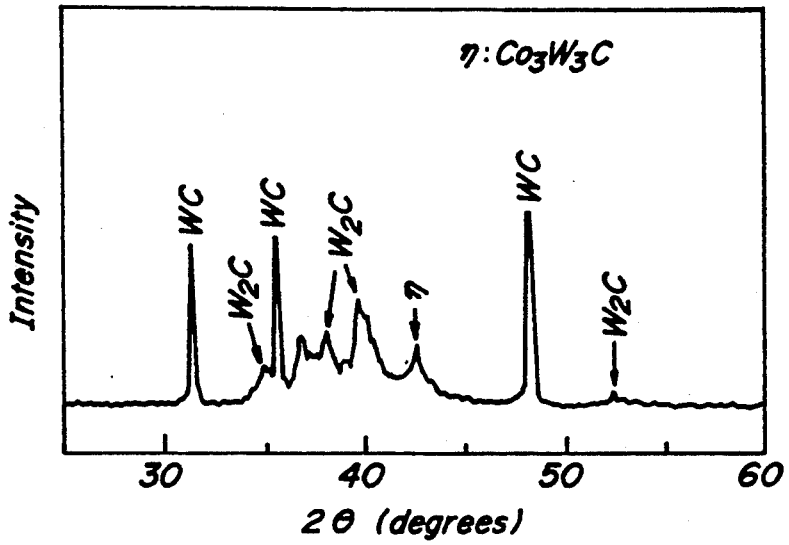

FIG. 2 shows the X-ray diffraction patterns of the spray-coated layers produced by plasma coating method in air (FIG. 2*a*) and by HVOF coating method (propylene as fuel) (FIG. 2*b*). Moreover, in both cases, WC-12Co spraying material produced by the sintering and crushing process, was used. As seen from FIG. 2, even when the same spraying material is sprayed, strong peaks of WC, $W_2C$ and W are identified in the spray-coated layer obtained by plasma coating method, and also the presence of free carbon can be observed. On the other hand, the spray-coated layer obtained by the HVOF coating method consists essentially of WC and contains $W_2C$ and $\eta$-phase ($Co_3W_3C$) but does not contain free W and C.

Table 1 shows the results of X-ray diffraction patterns for the spray-coated layers obtained by the plasma coating method and the HVOF coating method using the WC-12% Co spraying materials produced by the processes described above.

TABLE 1

| No | Manufacturing Method of Spraying Powder | Powder | Plasma Coating | HVOF Coating |
|---|---|---|---|---|
| 1 | Sintering and Crushing | $\underline{WC}$,$Co_3W_3C$ | $\underline{W}$,$W_2C$,C,B | $\underline{WC}$,$W_2C$,$Co_3W_3C$, $W_6C_{2.54}$ |
| 2 | Cast-Crushing and Fusing | $\underline{WC}$,$W_2C$, $Co_3W_3C$,$Co_6W_6C$ | $\underline{WC}$,$\underline{W_2C}$, $Co_2W_4C$,C | $\underline{WC}$,$W_2C$,W*, $Co_2W_4C$,C |
| 3 | Agglomerating | $\underline{WC}$,Co | $\underline{WC}$,W, $W_2C$,C,B | $\underline{WC}$,W, $W_2C$,C,B |
| 4 | Coating | $\underline{WC}$,Co | $\underline{WC}$,W,$W_2C$ | $\underline{WC}$,C,W |

Note:
B: Unknown broad peak in X-ray diffraction pattern
Underline: Main peaks
*Very small peak As seen from Table 1, in the spraying materials produced by the agglomerating process and the coating process, WC and Co are identified individually, so that it is apparent that both the components are existent in a mixed state. When the spraying material of such a mixed state is sprayed by the plasma coating or the HVOF coating method, Co is not identified in the resulting coated layer and free W is inversely detected.

On the other hand, the spraying material produced by the sintering and coating process consists essentially of WC and $Co_3W_3C$ as a reaction product between WC and Co before the coating, but when it is coated by the plasma coating method, W, $W_2C$, C and unidentifiable amorphous component (broad peak) are detected. However, when it is coated by the HVOF coating method, WC, $W_2C$, $Co_3W_3C$ and C are detected. Therefore, even when using the same material, if the coating method is different, the crystalline structure of the resulting spray-coated layer changes.

The phenomenon of changing the crystalline structure of the spraying material in the spray-coated layer, as described above, is common even in WC-5% Co, WC-17% Co, WC-28% Co materials, in addition to the WC-12% Co material, though the changing degree is somewhat different. That is, when the WC-5% Co spraying material, having a small Co content, is applied as a spray coating using the plasma coating method, W is strongly identified in the resulting spray-coated layer. However, when the WC-28% Co spraying material, having a high Co content, is applied as a spray coating using the HVOF coating method, unreacted Co is detected in the resulting spray-coated layer. These layers are poorly resistant to galvanizing bath solution and unsuitable as a coated layer according to the invention.

As is generally known, compounds capable of evaluation by X-ray diffractometry are restricted to compounds having crystallinity, while amorphous substances, and slight components of not more than 1%, cannot be detected. However, the inventors have found that the spraying material used in the invention and the spray-coated layer can be evaluated by the X-ray diffractometry, so that all evaluations in the invention are based on this method.

Furthermore, the X-ray diffraction apparatus used in the invention is an apparatus of RAD #C model made by Rigaku Denki Kabushiki Kaisha using CuKα line at 40 KV and 40 mA.

Moreover, various WC-Co cermet materials used in the invention contain not more than 2% of impurities such as Fe, Ni, Cr, C, Si and the like, when considering the incorporation of these impurities from the starting material or the production step.

On the other hand, even if the spray-coated layer is excellent in its resistance to galvanizing bath solution, when it contains many pores, hot zinc penetrates into the inside of the coated layer to erode the substrate of the roll. Furthermore, the coated layer is peeled off from the substrate. Therefore, it is important to control the porosity of the coated layer. In this regard, the inventors have observed the appearance of the spray-coated layers after the WC-Co coated layers (thickness: 150 μm), having different porosities, were prepared on carbon steel (JIS G 3101 SS400), by the plasma coating process, under atmospheric pressure, and the HVOF coating process, and then immersed in hot zinc at 480° C. for 3 days.

In this regard, the observed results are shown in Table 2. In particular, it is confirmed that the coated layer having a porosity of not more than 1.8% is not eroded by hot zinc and shows a sound state. On the other hand, the coated layer having a porosity of more than 2.0% is locally peeled off from the substrate or the substrate is largely eroded by hot zinc.

Moreover, the coated layer having the porosity of not more than 1.2% cannot be formed by the plasma coating process, while the more densified coated layer is obtained by the HVOF coating method.

The porosity of the coated layer is measured as follows:

At first, the section of the spray-coated layer is photographed and recorded by means of an optical microscope. Then, the pore portions of the layer in the photograph are colored. The colored photograph is then analyzed by an image analyzing apparatus which determines the ratio of colored area to the total recorded area of the photograph.

TABLE 2

| No | Porosity of coating (%) | Damaged area of coating (%) Plasma coating | HVOF coating |
|---|---|---|---|
| 1 | <0.5 | — | <0.01 |
| 2 | 0.8~1.0 | — | <0.01 |
| 3 | 1.2~1.5 | — | <0.01 |
| 4 | 1.6~1.8 | <0.05 | <0.01 |
| 5 | 2.0~2.3 | 3.6 | 2.5 |
| 6 | 2.5~3.5 | 38 | 32 |
| 7 | >3.8 | 45 | 46 |

Spraying powder: Sinter-Crushed WC-12% Co
Damaged area: Including the chipping, spalling by thermal shock and attached area by molen Zn In the spray-coated layer formed on the roll for galvanization, the thickness of the layer is an important factor, in addition to the above crystalline structure, of the components constituting the layer, and porosity of the layer. When the coated roll is immersed in the galvanizing bath at a high temperature and taken up therefrom, internal stress, based on the difference of thermal expansion coefficient between the coated layer and the roll substrate, is caused in accordance with the thermal change. As the difference of thermal expansion coefficient becomes large, the coated layer is apt to be peeled off from the roll substrate. Particularly, there is caused a phenomenon that a part of the coated layer is scattered off from the roll substrate, which is the so-called chipping phenomenon. Thus, when the thickness of the coated layer is too thick, it is easily peeled off from the roll substrate due to the difference in thermal expansion coefficient; while when the thickness is too thin, the pores are easily formed and hence hot zinc easily penetrates into the inside of the coated layer to lower the resistance to galvanizing bath solution.

As a result of the inventor' experiments, it has been confirmed that when using the spraying material according to the invention, the thickness of the resulting coated layer is preferably within a range of 0.04–1.85 mm. When the thickness is outside the above range, the coated layer is easily peeled off, and also the cost thereof increases together with the rise of the spraying material cost.

The following examples are given to illustrate the invention and are not intended as limitations thereof.

EXAMPLE 1

In this example, a spray-coated layer having a thickness of 0.15 mm and a porosity of 1.2–1.6% was formed on each of a sink roll, a support roll, a touch roll and a top roll used in the continuous galvanizing apparatus of FIG. 1 (a material of each roll is JIS G3445(1983) STKM13A). The spray-coated layer was applied through the HVOF coating method using a WC-12% Co spraying material produced by the sintering and crushing process and agglomerating process. Then, a steel sheet of 900 mm in width and 0.35 mm in thickness was immersed in a galvanizing bath containing molten zinc (JIS H2107 (1957) corresponding to special distilled zinc) at 470°–480° C. using these rolls to conduct a continuous galvanization treatment, during which the change of the spray-coated layer was measured.

For comparison, rolls having no coated layer made from STKM13A, SCS1 or SCS12 (corresponding to JIS G5121 (1980)) were used in the continuous galvanization treatment. The chemical compositions of these roll materials are shown in Table 3.

TABLE 3

| Symbol | Chemical Composition (wt %) C | Si | Mn | P | S | Ni | Cr | Remarks |
|---|---|---|---|---|---|---|---|---|
| STKM13A | 0.18 | 0.28 | 0.45 | 0.021 | 0.019 | — | — | |
| SCS1 | 0.09 | 1.25 | 0.68 | 0.015 | 0.018 | — | 12.80 | corresponding ASTM CA 15 |
| SCS12 | 0.14 | 1.33 | 1.41 | 0.017 | 0.015 | 9.01 | 19.25 | corresponding ASTM CA 20 |

After one week of the galvanization, the roll surface was observed irrespective of the presence of the spray-coated layer to obtain results as shown in Table 4.

TABLE 4

| No | Spraying Powder and Roll Material | Damaged area of coating [Zinc deposition area (%)] Sink Roll | Support Roll | Touch Roll | Top Roll |
|---|---|---|---|---|---|
| 1 | Powder by sintering and crushing process | <0.01 | <0.01 | <0.01 [2.5] | <0.01 [1.2] |
| 2 | Powder by Agglomerating process | 39.5 | 29.8 | 2.5 [15.2] | 1.8 [8.2] |
| 3 | STKM13A | Severe attack | Severe attack | [20.8] | [16.8] |
| 4 | SCS 1 | Severe attack | Severe attack | [11.3] | [6.3] |
| 5 | SCS 12 | Attack | Attack | [8.9] | [3.5] |

Spraying Gun: HVOF
Thickness of Coating: 0.15 mm
Porosity of Coating: 1.2~1.6%

As seen from these results, the surfaces of the rolls always contacting the hot zinc and having no coated layer, particularly the sink roll, support roll and the like, were considerably eroded. In this regard, damage of about 3 mm in thickness was observed even in the roll of austenitic SCS 12. The erosion was further conspicuous in the rolls of SCS1 and STKM13, which were not durable to next use. Furthermore, soft zinc was strongly adhered to a portion of the galvanization line contacting with the steel sheet after passing through the galvanizing bath, such as a top roll or the like (hot zinc was not sufficiently cooled and solidified). This damage to the roll due to zinc adhered to the roll surface, resulted in damage to the surface of the galvanized steel sheet, and hence the quality of the sheet is considerably lowered.

On the contrary, the roll substrate provided, at its surface, with the spray-coated layer, showed a relatively sound state. In the spray-coated layer formed on the sink roll, support roll or the like by the agglomerating process, many peelings of about 20–50 mm in diameter were caused and the total peeled area was 30–40% of the full spray-coated area. Further, the exposed portion of the roll substrate was eroded by hot zinc, but the eroded degree of the roll was relatively small as compared with the case of using the roll having no spray-coated layer.

In the spray-coated layer made from the spraying material through the sintering and crushing process, the erosion of hot zinc was hardly observed, and also the peeling of the coated layer was only about 0.5–10. mm in diameter and the total peeled areas was not more than 0.01% of the full spray-coated area.

Moreover, in the rolls having the spray-coated layer, the influence of the roll material was not recognized, and the coated layer formed on the roll made from any material develops excellent resistance to galvanizing bath solution.

In the spray-coated layer formed on the top roll and made from the spraying material through the sintering and crushing process, the adhesion of zinc was extremely small and the adhered zinc was easily peeled from the roll by lightly rubbing. On the other hand, zinc was strongly adhered to the coated layer made from the material through the agglomerating process, and also the adhered amount of zinc was larger than that of the former case.

As seen from the above, the spray-coated layer formed from WC-12% Co spraying material through the sintering and crushing process exhibits excellent resistance to galvanizing bath solution, and minimal adhesion of zinc. Moreover, the galvanization apparatus using rolls, each provided with this spray-coated layer, is suitable for efficiently producing a galvanized steel sheet having an excellent quality.

EXAMPLE 2

On the sink roll of the same continuous galvanization apparatus as in Example 1, various spray-coated layers were tested. All of the coatings that were tested had a thickness of 0.18 mm and a porosity of 1.2–1.6% by the HVOF coating method using WC-12% Co spraying material. However, the process for producing the spraying material varied and included the sintering and crushing process, cast-crushing and fusing process, agglomerating process or coating process. Then a steel sheet of 900 mm in width and 0.35 mm in thickness was subjected to a continuous galvanization treatment by passing through a galvanizing bath at 470°–480° C. through the above rolls, during which the effect of the spray-coated layer was examined.

Moreover, the continuous galvanization was conducted for 1 week by adding 0.05 wt %, 0.10 wt %, 0.30 wt %, 3 wt % or 5 wt % of Al to the galvanizing bath.

The results are shown in Table 5.

TABLE 5

| | Manufacturing process spraying powder | Damaged area of coating (%) Al content (wt %) | | | | |
|---|---|---|---|---|---|---|
| | | 0.05 | 0.10 | 0.30 | 3.0 | 5.0 |
| Invention Example | Sintering and crushing | <0.01 | <0.01 | <0.01 | <0.01 | <0.01 |
| | Cast-crushing and Fusing | <0.01 | <0.01 | <0.01 | <0.01 | <0.01 |
| Comparative Example | Agglomerating | 5.8 | 7.8 | 6.5 | 10.5 | 8.9 |
| | Coating | 8.5 | 7.8 | 11.5 | 15.6 | 20.2 |

As seen from Table 5, there was slight peeling of the outermost layer of the spray-coated layers due to thermal shock from the immersion into high temperature galvanizing bath of the materials produced by the sintering and crushing process and the cast-crushing and fusing process, described above. However, the total peeled area was not more than 0.01% of the full spray-coated area. Furthermore, coated layer remained beneath the slight peeled portion, so that the roll substrate was not subjected to erosion through hot zinc. Thus, the spray-coated layer according to the invention exhibited an excellent erosion resistance against the galvanizing bath containing 0.05–5 wt % of Al. On the other hand, the spray-coated layers made from the spraying materials produced by the agglomerating process and the coating process were considerably eroded similar to the pure galvanizing bath of Example 1, and not less than 50% of the coated layer was peeled off from the roll surface.

As mentioned above, according to the present invention, the spray-coated layer consists of WC, $W_2C$, $W_6C_{2.54}$, $Co_2W_4C$, $Co_6W_6C$, $Co_3W_4C$ and C, and contains no free W and Co identifiable by X-ray diffractometry. This spray-coated layer is formed on a surface of a roll used in the galvanization process. According to the present invention, this spray coated layer should have a porosity of not more than 18.% and shows an excellent erosion resistance to hot zinc or a galvanizing bath containing 0.05–5 wt % of Al. By using such a spray-coated layer there can be ensured stable galvanizing operation, high productivity and improvement of quality in the galvanized steel sheet.

What is claimed is:

1. A spray-coated roll for continuous galvanization comprising a roll drum and a spray-coated layer of a cermet material comprising WC-Co formed on an outer peripheral surface of the roll drum; said spray-coated layer containing at least one substance selected from the group consisting of intermetallic compound, amorphous W-C-Co compound and free carbon and having a structure that free W and free Co are hardly identified by X-ray diffractometry; and said intermetallic compound being selected from the group consisting of $W_2C$, $Co_3W_3C$, $Co_6W_6C$, $Co_2W_4C$, $Co_2W_4C$ and $W_6C_{2.54}$.

2. The roll according to claim 1, wherein said spray-coated layer has a thickness of 0.04–1.85 mm.

3. The roll according to claim 1, wherein said spray-coated layer has a porosity of not more than 1.8%.

4. The roll according to claim 1, wherein said cermet material is obtained by sintering WC and Co at a temperature of not lower than 1000° C. in a hydrogen gas atmosphere having a low partial oxygen pressure and crushing and sieving the resulting sintered product.

5. The roll according to claim 1, wherein said cermet material is obtained by melting Co in an atmosphere containing no oxygen, charging WC particles into molten Co to react them and crushing and sieving the resulting reaction product.

6. The roll according to claim 1, wherein said cermet material is obtained by sintering WC and Co at a temperature of not lower than 1000° C. in a hydrogen gas atmosphere having a low partial oxygen pressure and crushing and sieving the resulting sintered product or melting Co in an atmosphere containing no oxygen, charging WC particles into molten Co to react them and crushing and sieving the resulting reaction product, and then melting the resulting sieved particles and pulverizing and sieving them.

7. The roll according to claim 1, wherein said spray-coated layer is formed by spraying said cermet material through a method selected from the group consisting of a plasma coating method, a high-velocity oxygen/fuel coating method and a detonation coating method.

* * * * *